US007484252B2

(12) United States Patent
Wang

(10) Patent No.: US 7,484,252 B2
(45) Date of Patent: Feb. 3, 2009

(54) AUTOMATIC PATIENT TRANSFER SYSTEM

(76) Inventor: Xiao Dong Wang, No. 88, Anping Road, Zhuji City, Zhejiang Province (CN)

( * ) Notice: Subject to any disclaimer, the term of this patent is extended or adjusted under 35 U.S.C. 154(b) by 298 days.

(21) Appl. No.: 11/413,915

(22) Filed: Apr. 27, 2006

(65) Prior Publication Data

US 2007/0251004 A1 Nov. 1, 2007

(51) Int. Cl.
*A61G 7/10* (2006.01)

(52) U.S. Cl. ..... 5/81.1 C; 5/81.1 HS; 5/86.1

(58) Field of Classification Search ..... 5/81.1 HS, 5/81.1 C, 81.1 R, 83.1, 86.1
See application file for complete search history.

(56) References Cited

U.S. PATENT DOCUMENTS 3,967,328 A * 7/1976 Cox ..... 5/81.1 C
3,988,790 A * 11/1976 Mracek et al. ..... 5/83.1
4,761,841 A * 8/1988 Larsen ..... 5/81.1 C
5,048,133 A * 9/1991 Iura et al. ..... 5/81.1 C
5,855,207 A * 1/1999 Moenning et al. ..... 128/845
6,854,137 B2 * 2/2005 Johnson ..... 5/88.1

* cited by examiner

*Primary Examiner*—Michael Trettel
(74) *Attorney, Agent, or Firm*—Raymond Y. Chan; David and Raymond Patent Firm

(57) ABSTRACT

An automatic patient transfer system includes a transporting cart, a supporting frame mounted on the transporting cart in vertically movable manner to adjust a height of the supporting frame, and an endless conveyer platform. The supporting frame includes two spaced apart transverse arms and a supporting bed, having a two-side-accessing ability, slidably mounted between the two transverse arms in a horizontal movable manner, such that the supporting bed is selectively and sidewardly slid with respect to the transporting cart to allow the supporting bed selectively sliding at two opposing sideward directions. The endless conveyer platform is slidably mounted at the supporting bed in loop manner, wherein the conveyer platform is adapted for supporting the patient thereon to selectively load and unload the patient on the supporting bed when the conveyer platform is endlessly rotated at clockwise and counter-clockwise directions.

9 Claims, 14 Drawing Sheets

AUTOMATIC PATIENT TRANSFER SYSTEM

BACKGROUND OF THE PRESENT INVENTION

1. Field of Invention

The present invention relates to a mobile cart, and more particularly to an automatic patient transfer system, having two-side accessing ability, adapted for loading, unloading and transporting a patient from facilities to facilities.

2. Description of Related Arts

Medical attendants always require moving an injured or incapacitated patient from facilities to facilities. Conventionally, the medical attendants use a litter to carry the immobilized patient for transportation. However, the patient's physical condition, size, weight, deformities and physical impairments must be concerned when using litter. An improved transporting cart is used to substitute with the litter for transferring patient. Such transporting cart comprises a platform for supporting the patient thereon and a wheel table mounted underneath the platform in such a manner that when the wheel table is moved next to a suitable bed, the platform is adapted to sidewardly slide towards the bed so as to lift or transfer the patient from the transporting cart to the bed. However, such transporting cart has several drawbacks.

The platform can be sidewardly slid in one-single direction. In other words, the platform can be either slid from the right side or the left side of the transporting cart. Therefore, the medical attendants must remember which side of the platform can be accessed. It will waste lots of precious time for the medical attendants to move the transporting cart back to the corresponding side to the suitable bed if the transporting cart is moved at the wrong side with respect to the suitable bed. In addition, the suitable bed in the hospital must design to incorporate with the corresponding accessing side of the transporting cart.

Furthermore, the sideward sliding movement of the platform must be smooth to reduce the vibration of the platform so as to minimize the unwanted pain of the patient during the loading and unloading operation.

SUMMARY OF THE PRESENT INVENTION

A main object of the present invention is to provide an automatic patient transfer system, which provides a two-side accessing ability for loading, unloading and transporting a patient from facilities to facilities.

Another object of the present invention is to provide an automatic patient transfer system, wherein the supporting bed is allowed to sidewardly slide in two opposed directions such that the patient can be loaded and unloaded between the supporting bed and the suitable bed at two sides thereof, so as to save the precious time for the medical attendants.

Another object of the present invention is to provide an automatic patient transfer system, wherein an endless conveyer platform is mounted on the supporting bed in an endless sliding manner to automatically load and unload the patient between the supporting bed and the suitable bed.

Another object of the present invention is to provide an automatic patient transfer system, wherein two longitudinal driving shafts are rotatably mounted at two sides of the supporting bed to drive the conveyer platform to slide so as to more evenly distribute and support the downward force of the patient's weight applied on the conveyer platform in stable manner.

Another object of the present invention is to provide an automatic patient transfer system, wherein the supporting bed is adjustably mounted on the transporting base to selectively adjust a height of the supporting bed corresponding to the suitable bed, so as to give facilities for the medical attendants to load, unload and transport the patient.

Another object of the present invention is to provide an automatic patient transfer system, wherein the conveyer platform is slidably mount on the supporting bed via a gear transmitting unit to reduce the vibration of the conveyer platform so as to minimize the unwanted pain and further injury of the patient during the sliding operation.

Another object of the present invention is to provide an automatic patient transfer system, which is automatically controlled by the control panel to control the height of the supporting bed, the sideward sliding movement of the supporting bed, and the sliding movement of the conveyer platform, so as to allow the medical attendants to fully access the automatic patient transfer system to fit the patient's physical condition, size, weight, deformities and physical impairments.

Another object of the present invention is to provide an automatic patient transfer system, wherein no expensive or complicated structure is required to employ in the present invention in order to achieve the above mentioned objects. Therefore, the present invention successfully provides an economic and efficient solution for providing a safety configuration for the loading, unloading and transporting the patient.

Accordingly, in order to accomplish the above objects, the present invention provides an automatic patient transfer system for loading, unloading, and transporting a patient, comprising:

a transporting cart which comprises a base stand and a plurality of wheels rotatably mounted underneath the base stand;

a supporting frame mounted on the transporting cart in vertically movable manner to adjust a height of the supporting frame, wherein the supporting frame comprises two spaced apart transverse arms and a supporting bed, having a two-side-accessing ability, slidably mounted between the two transverse arms in a horizontal movable manner, such that the supporting bed is selectively and sidewardly slid with respect to the transporting cart to allow the supporting bed selectively sliding at two opposing sideward directions; and an endless conveyer platform slidably mounted at the supporting bed in loop manner, wherein the conveyer platform is adapted for supporting the patient thereon to selectively load and unload the patient on the supporting bed when the conveyer platform is endlessly rotated at clockwise and counter-clockwise directions.

These and other objectives, features, and advantages of the present invention will become apparent from the following detailed description, the accompanying drawings, and the appended claims.

DETAILED DESCRIPTION OF THE PREFERRED EMBODIMENT

Figure 1:
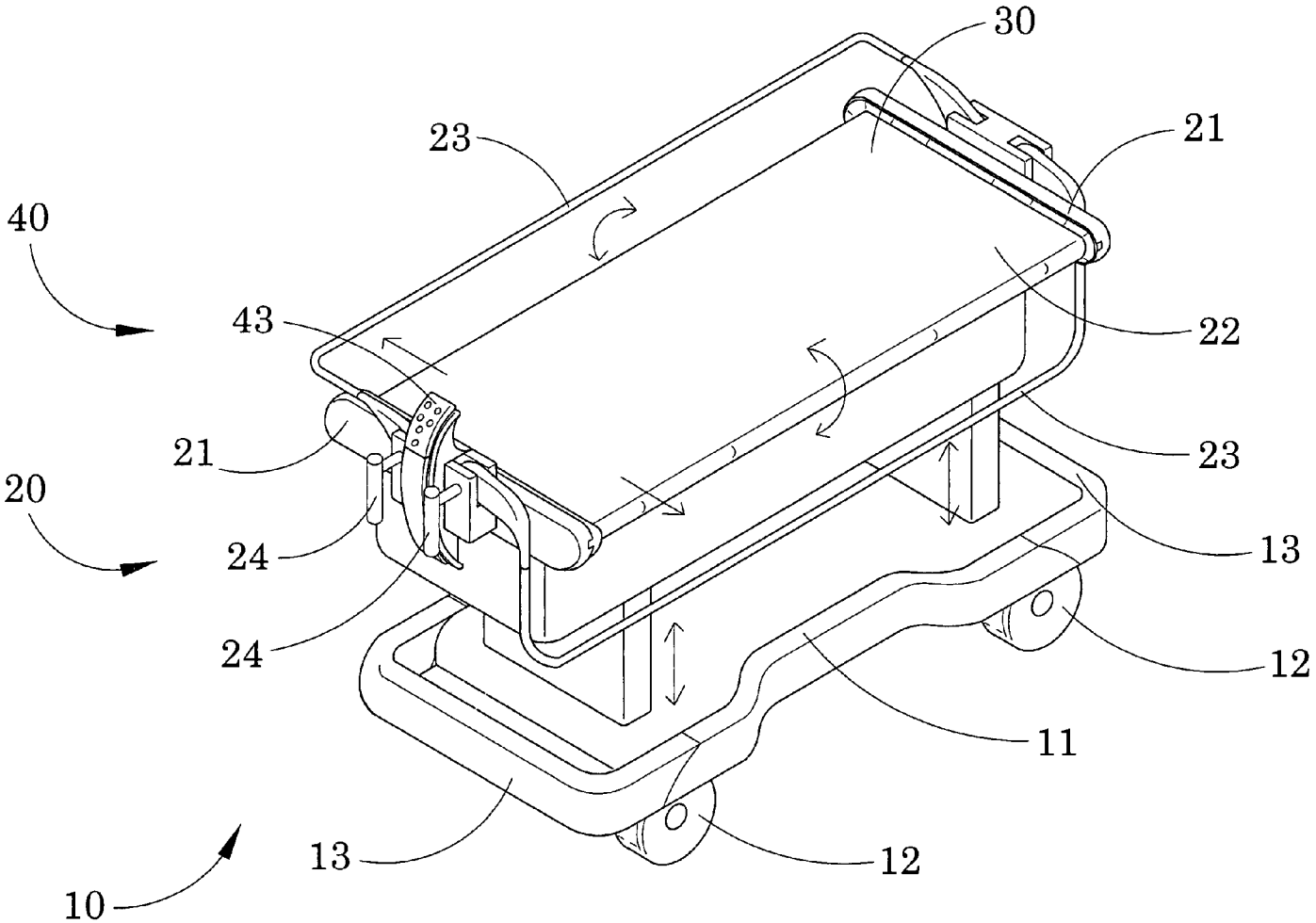
FIG. 1 is a perspective view of an automatic patient transfer system according to a preferred embodiment of the present invention.
Figure 2:
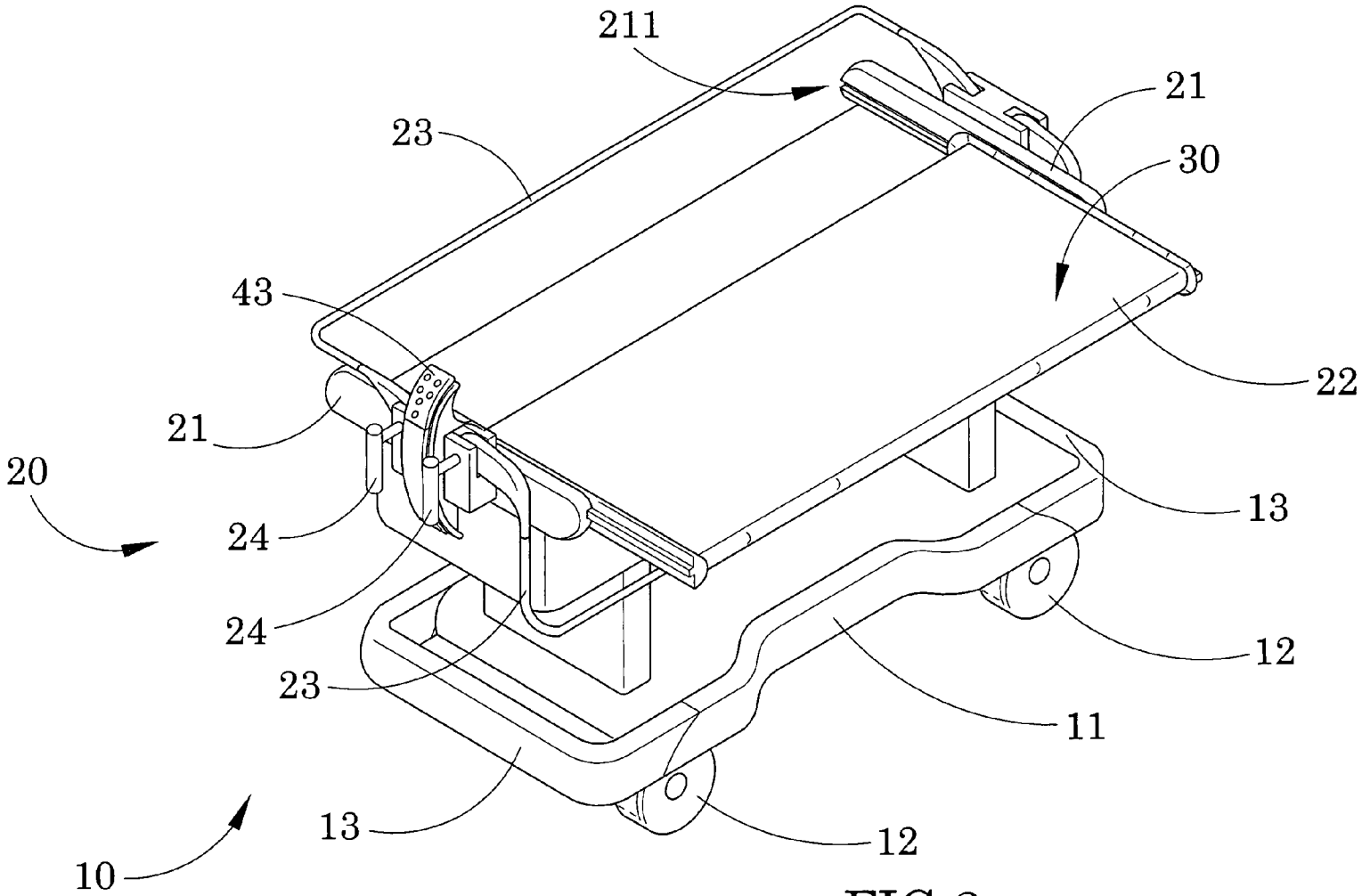
FIG. 2 is a perspective view of an automatic patient transfer system according to the above preferred embodiment of the present invention, illustrating the supporting bed being sidewardly slid from the transporting cart.

Referring to FIGS. 1 to 2 of the drawings, an automatic patient transfer system according to a preferred embodiment of the present invention is illustrated, wherein the automatic patient transfer system, which is adapted for efficiently loading, unloading, and transporting a patient from facilities to facilities, comprises a transporting cart 10, a supporting frame 20, and an endless conveyer platform 30.

Figure 3:
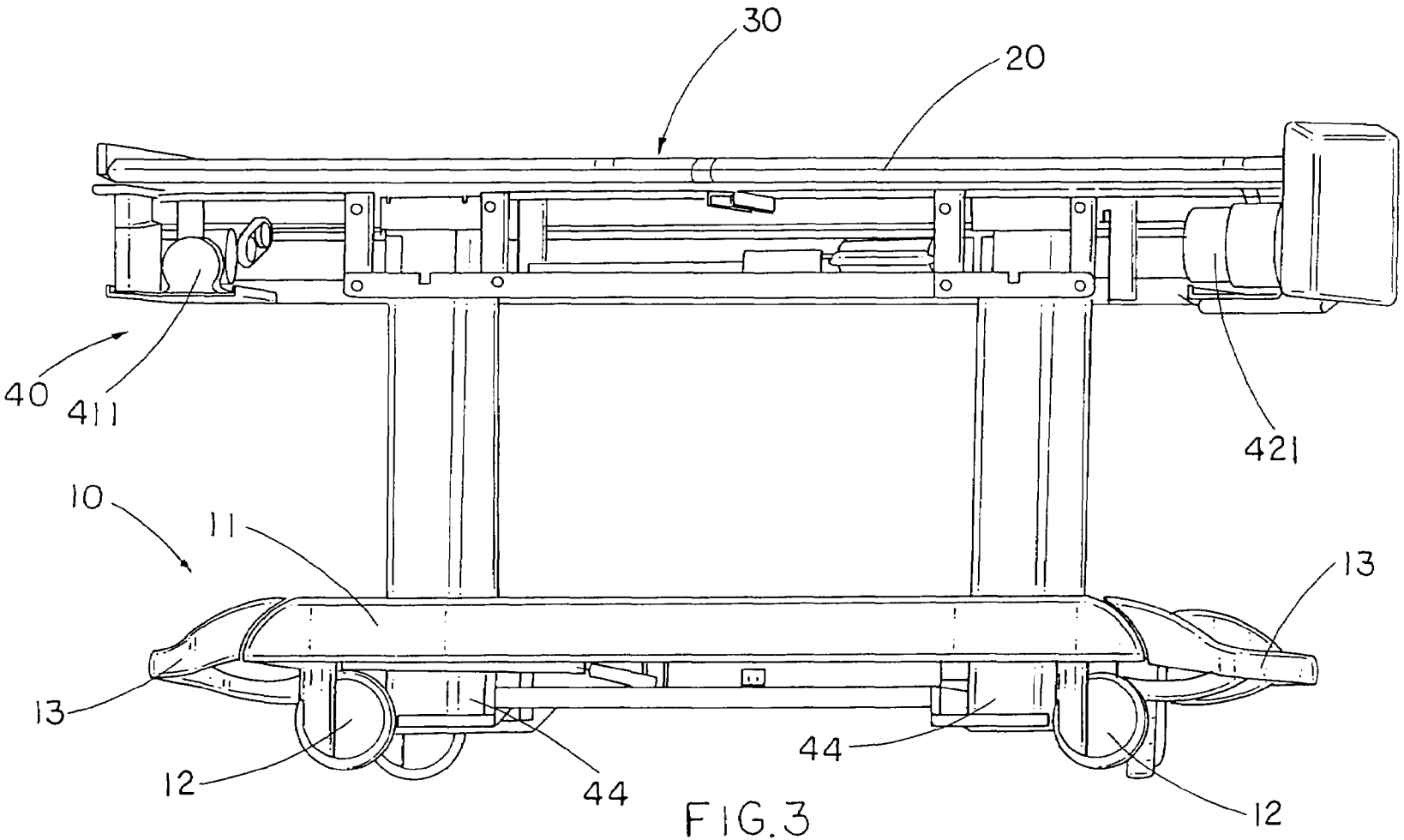
FIG. 3 is a perspective view of the automatic patient transfer system according to the above preferred embodiment of the present invention, illustrating the power control mechanism.

As shown in FIGS. 1 to 3, the transporting cart 10 comprises a base stand 11 and a plurality of wheels 12 rotatably mounted underneath the base stand 11, wherein a plurality of wheel locks 13 coupled with the wheels 12 respectively to selectively lock up the wheels 12 in rotating manner.

The supporting frame 20 is mounted on the transporting cart 10 in vertically movable manner to adjust a height of the supporting frame 20, wherein the supporting frame 20 comprises two spaced apart transverse arms 21 and a supporting bed 22, having a two-side-accessing ability, slidably mounted between the two transverse arms 21 in a horizontal movable manner, such that the supporting bed 22 is selectively and sidewardly slid with respect to the transporting cart 10 to allow the supporting bed 22 selectively sliding at two opposing sideward directions. In other words, the supporting bed 22 can be selectively slid at the right side or at the left side of the transporting cart 10 so as to enhance the loading and unloading operation of the automatic patient transfer system.

Figure 6:
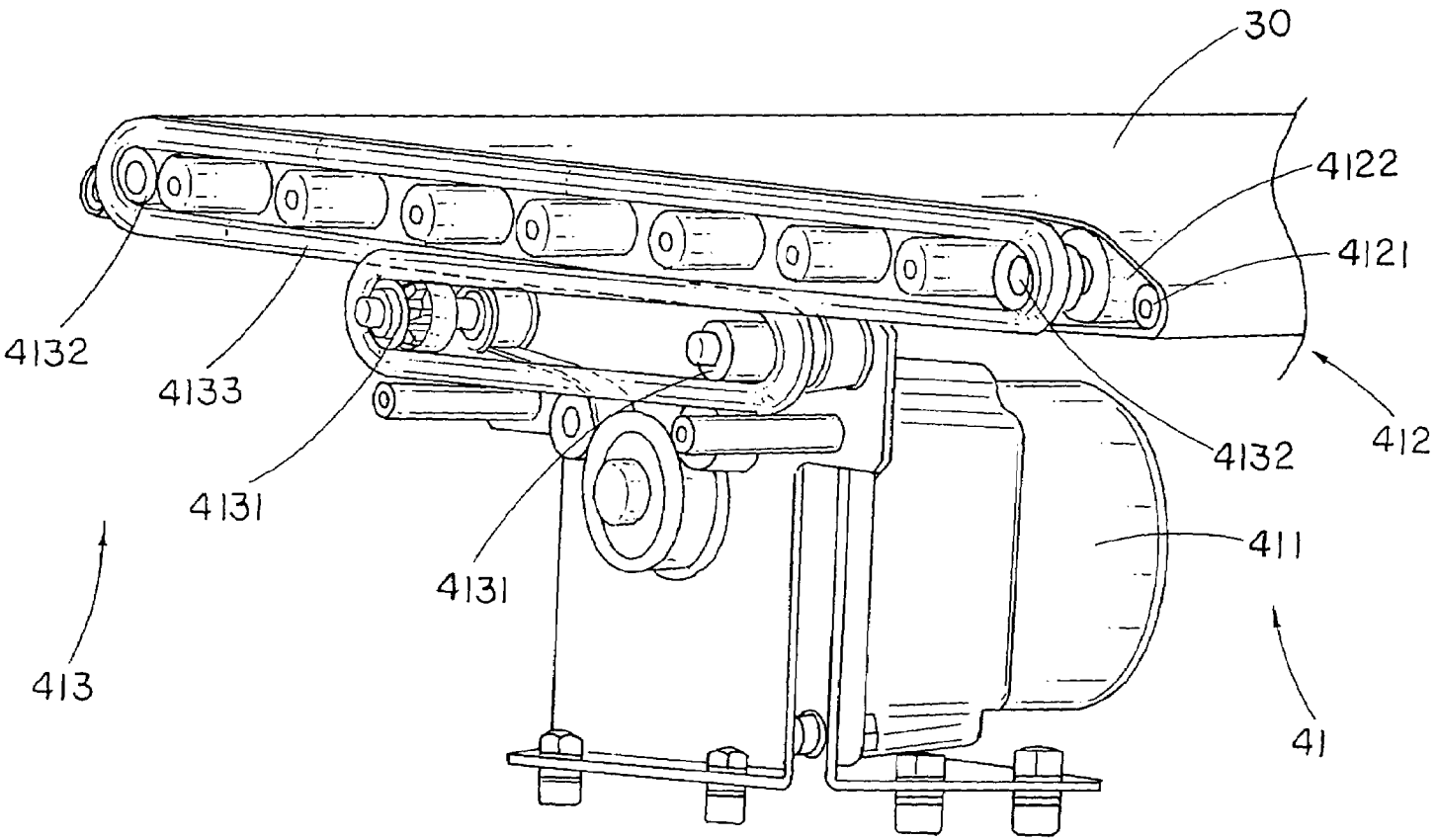
FIG. 6 is a perspective view of the platform driving device of the automatic patient transfer system according to the above preferred embodiment of the present invention.
Figure 7:
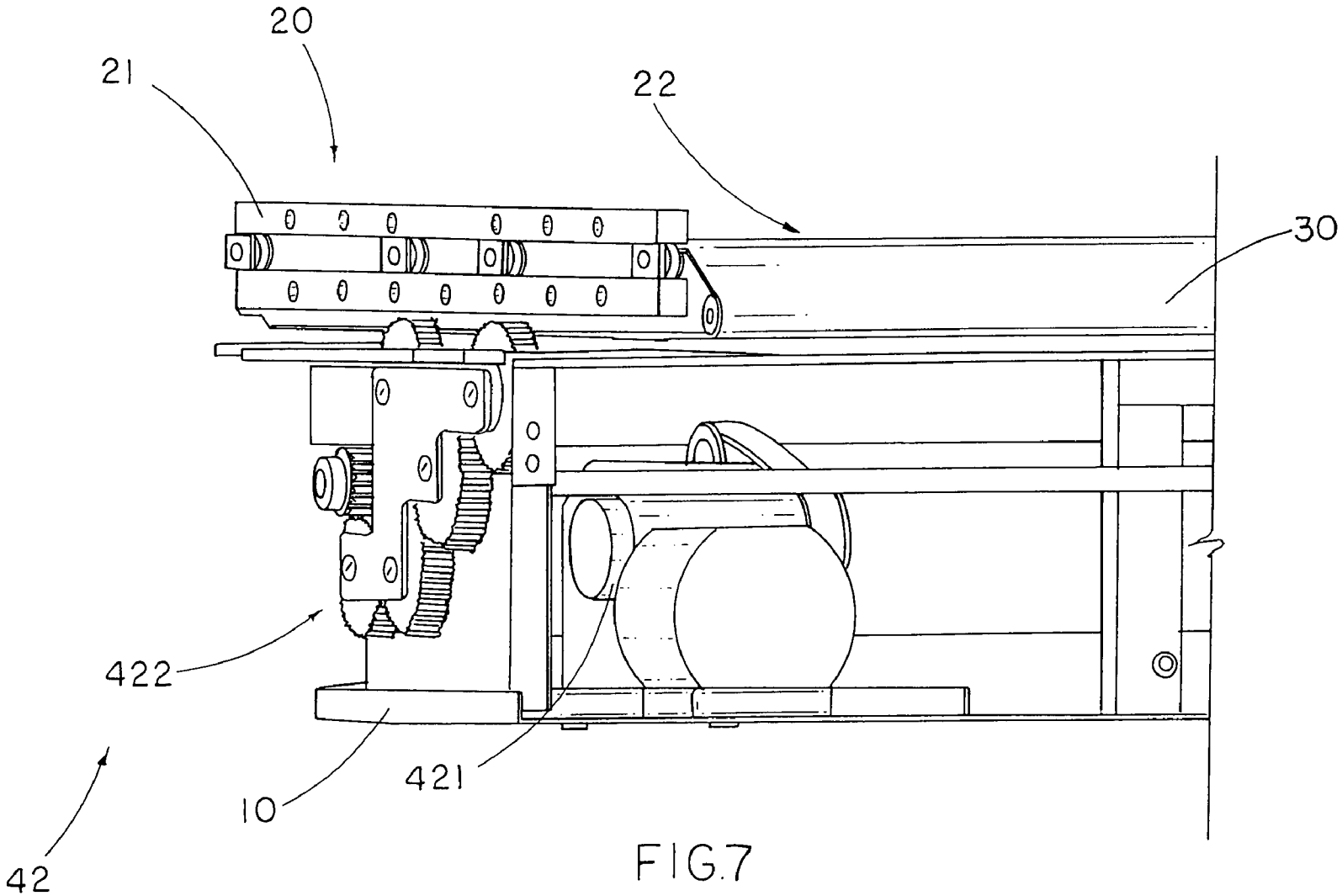
FIG. 7 is a perspective side view of the bed driving device of the automatic patient transfer system according to the above preferred embodiment of the present invention.

The conveyer platform 30 is slidably mounted at the supporting bed 22 in loop manner, wherein the conveyer platform 30 is adapted for supporting the patient thereon to selectively load and unload the patient on the supporting bed 22 when the conveyer platform 30 is endlessly rotated at clockwise and counter-clockwise directions, as shown in FIGS. 1 and 6.

According to the preferred embodiment, the conveyer platform 30 comprises a tension loop having a predetermined tension surface for supporting the patient thereon. The conveyer platform 30 is preferably made of flexible material to provide the tension surface to support the patient while the conveyer platform 30 is adapted to be rotatably slid on the supporting bed 20 in an endless manner.

The supporting frame 20 further comprises two side guiders 23 longitudinally extended along two sides of the supporting bed 22 respectively, wherein each of the side guiders 23 has two ends pivotally coupling with the transverse arms 21 respectively to pivotally fold at a upper guiding position that the side guider 23 is upwardly folded above the supporting bed 22 to block the supporting bed 22 sliding sidewardly and at a lower accessible position that the side guider 23 is downwardly folded below the supporting bed 22 to allow the supporting bed 22 to slide sidewardly. In other words, the side guiders 23 function as the safety guide to prevent the patient from falling down from the conveyer platform 30 during transportation. It is worth to mention that the side guider 23 must be pivotally folded at the accessible position in order to allow the supporting bed 22 to slide sidewardly.

Figure 8:
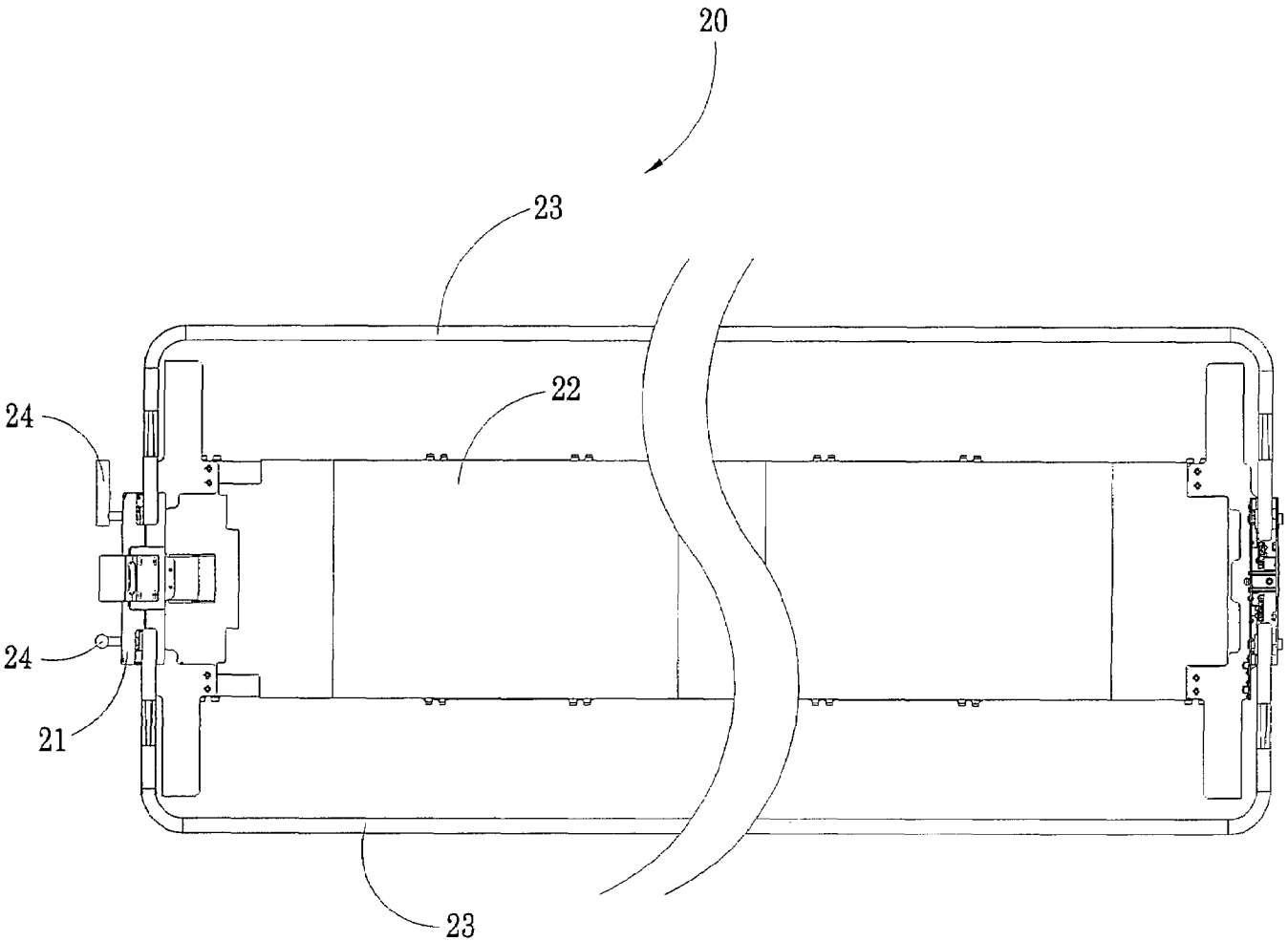
FIG. 8 is a top sectional view of the automatic patient transfer system according to the above preferred embodiment of the present invention, illustrating the guider locker.
Figure 9:
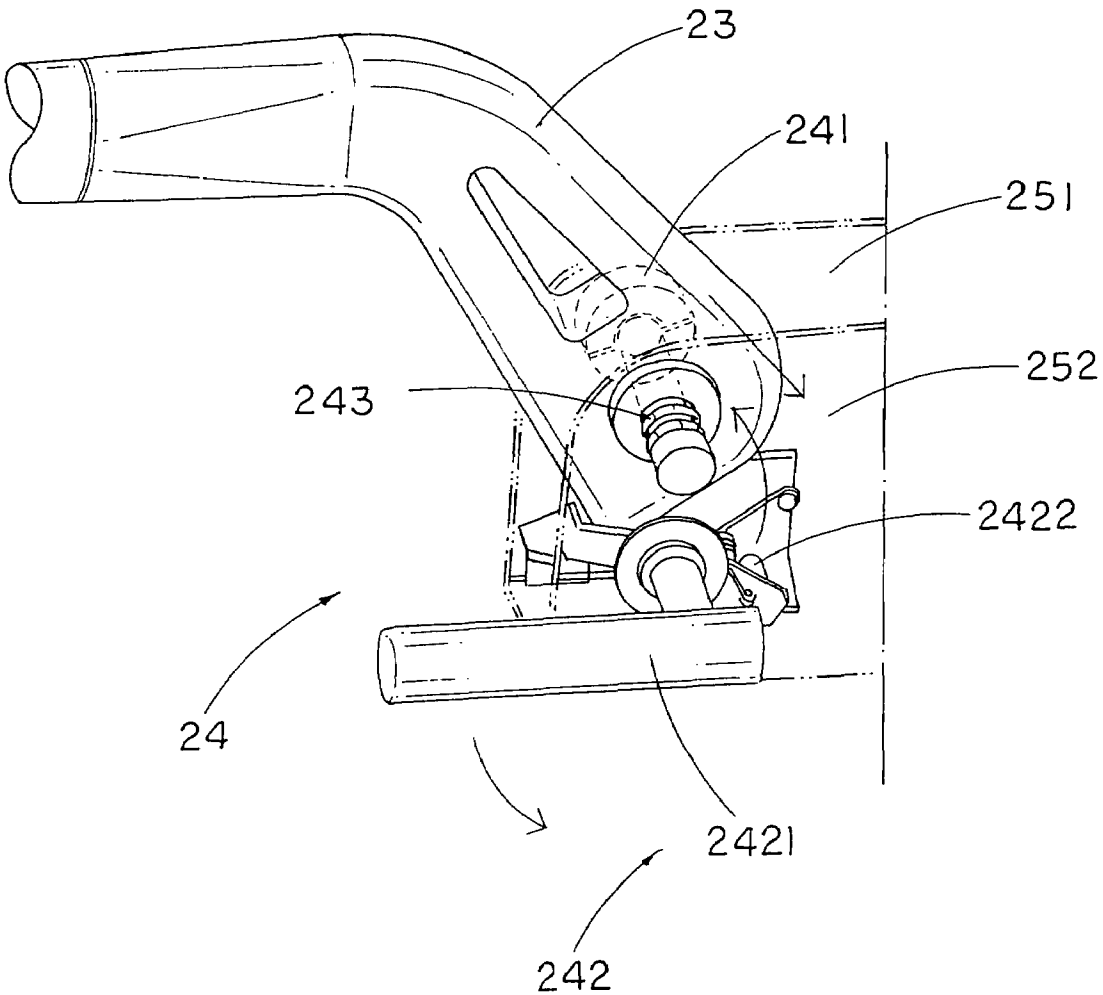
FIG. 9 is a partially perspective view of the guider locker of the automatic patient transfer system according to the above preferred embodiment of the present invention.

The automatic patient transfer system further comprises two guider lockers 24 mounted at the supporting frame 20 to selectively lock up the side guiders 23 at the guiding position. As shown in FIGS. 8 and 9, each of the guider lockers 24 comprises a blocking unit 241 mounted at the supporting frame 20 to block the respective side guider 23 from being folded pivotally, and a locker handle 242 rotatably mounted at the supporting frame 20 to lock up the respective side guider 23 at a position that the side guider 23 is normally engaged with the respective side guider 23, wherein when the locker handle 242 is rotated to release the lock up position of the respective side guider 23, the side guider 23 is allowed to slidably pulled to disengage with the blocking unit 241 such that the side guider 23 is adapted to pivotally fold from the guiding position to the accessible position.

Accordingly, the supporting frame 20 has first and second locker walls 251, 252 to pivotally mount the respective end of the side guider 23 therebetween, wherein the blocking unit 241 is mounted at the first locker wall 251 while the locker handle 242 is rotatably mounted at the second locker wall 252.

The locker handle 242 has a handle portion 2421 extended at an outer side of the second locker wall 252 and a retaining portion 2422 extended towards the first locker wall 251 to block the respective side guider 23 from slidably pulling towards the first locker wall 251. Therefore, when the handle portion 2421 of the locker handle 242 is rotated to drive the retaining portion 2422 to move away from the respective end of the side guider 23, the side guider 23 is allowed to longitudinally pull to disengage with the blocking unit 241 so as to pivotally fold from the guiding position to the accessible position.

Each of the guider lockers 24 further comprises a resilient element 243 disposed between the first and second locker walls 251, 252 for applying an urging force against the respective side guider 23 to retain the engagement between the side guider 23 and the respective blocking unit 241. The resilient element 243 comprises a compression spring having two ends biasing against the end of the side guider 23 and the second locker wall 252 to push the side guider 23 engaging with the blocking unit 241. Therefore, when the locker handle 242 is rotated to release the lock up position of the respective side guider 23, the side guider 23 is allowed to slidably pull towards the second locker wall 252 to compress the resilient element 243 so as to pivotally fold from the guiding position to the accessible position.

The automatic patient transfer system further comprises a power control mechanism 40 to automatically control the supporting bed 22 and the conveyer platform 30, wherein the power control mechanism 40 comprises a platform driving device 41 operatively driving the conveyer platform 30 to sidewardly slide on the supporting bed 22, a bed driving device 42 operatively driving the supporting bed 22 to sidewardly slide on the transporting cart 10, and a control panel 43 electrically connecting with the platform driving device 41 and the bed driving device 42 to selectively operate the conveyer platform 30 and the supporting bed 22. It is worth to mention that the operations of the platform driving device 41 and the bed driving device 42 are performed individually such that the control panel 43 is adapted to selectively operate the conveyer platform 30 and the supporting bed 22.

The power control mechanism 40 further comprises a hydraulic device 44 mounted in the base stand 11 to electrically connect with the control panel 43 to selectively lift up and drop down the supporting frame 20 by means of hydraulic force.

The platform driving device 41 comprises a platform driving motor 411 mounted at the transport cart 10 underneath the supporting frame 20 to electrically connect with the control panel 43, two shaft units 412 longitudinally and rotatably extended along two sides of the supporting bed 22 to abut against an inner surface of the conveyer platform 30, and a platform gear unit 413 coupling the platform driving motor 411 with the shaft units 412 in such a manner that when the platform driving motor 411 operates, the shaft units 412 are driven to rotate through the platform gear unit 413 so as to provides a linear rotating movement at each of the shaft units 412 to drive the conveyer platform 30 to slidably rotate on the supporting bed 22.

As shown in FIGS. 3 and 6, the platform driving motor 411 is an electric motor having a power output to generate a rotating output power to drive the shaft units 412 through the platform gear unit 413. It is worth to mention that the platform driving motor 411 remains in an idle manner when the side guider 23 is at the upper guiding position for safety purpose. Once the side guider 23 is pivotally folded to the lower accessing position, the platform driving motor 411 is activated to drive the supporting bed 22 to slide to the corresponding side of the transporting cart 10.

Figure 4:
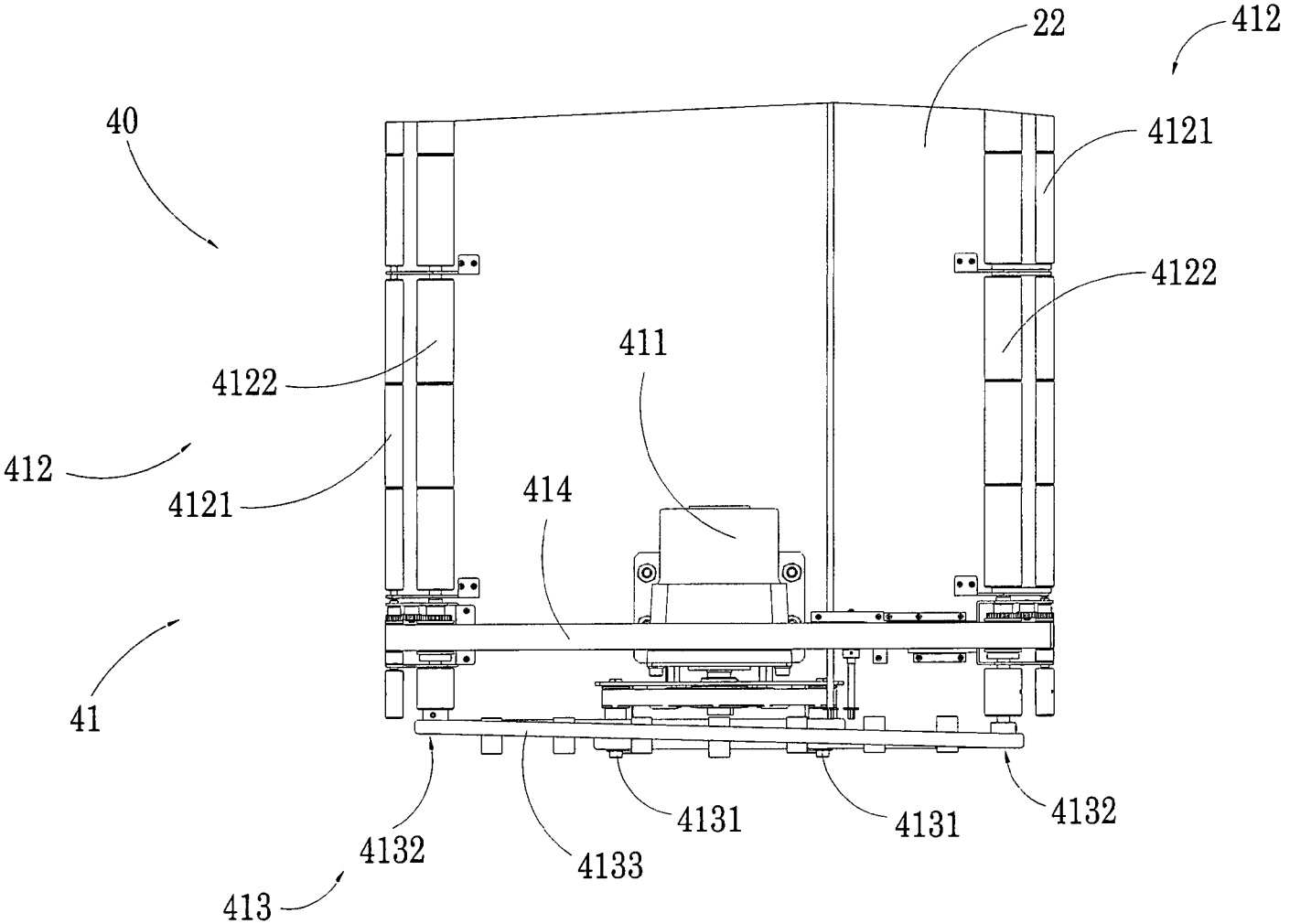
FIG. 4 is a top view of a platform driving device of the automatic patient transfer system according to the above preferred embodiment of the present invention.

As shown in FIG. 4, each of the shaft units 412 comprises an outer shaft 4121 abutting against the inner surface of the conveyer platform 30 and an inner shaft 4122 parallely extended with the outer shaft 4121 to engage with the outer shaft 4121, wherein the platform gear unit 413 is coupled with the two inner shafts 4122 such that when the inner shafts 4122 are driven to rotate, the two outer shaft 4121 are driven to rotate so as to drive the conveyer platform 30 to sidewardly slide on the supporting bed 22. Accordingly, when the shaft units 412 are rotated at the clockwise direction, the conveyer platform 30 is driven to slide at one sideward direction and when the shaft units 412 are rotated at the counter clockwise direction, the conveyer platform 30 is driven to slide at an opposed sideward direction. In other words, the control panel 43 controls the conveyer platform 30 to selectively slide at two sideward directions.

According to the preferred embodiment, the platform driving device 41 further comprises an endless synchronizing belt 414 engaging with two shaft units 412 to synchronize the two shaft units 412 while being rotated. As shown in FIG. 4, the synchronizing belt 414 is substantially engaged with the two outer shafts 4121 to synchronize the two outer shafts 4121 while being rotated. It is worth to mention that a plurality of engaging teeth are evenly formed on an inner surface of the synchronizing belt 414 to engage with the outer shafts 4121.

Figure 5:
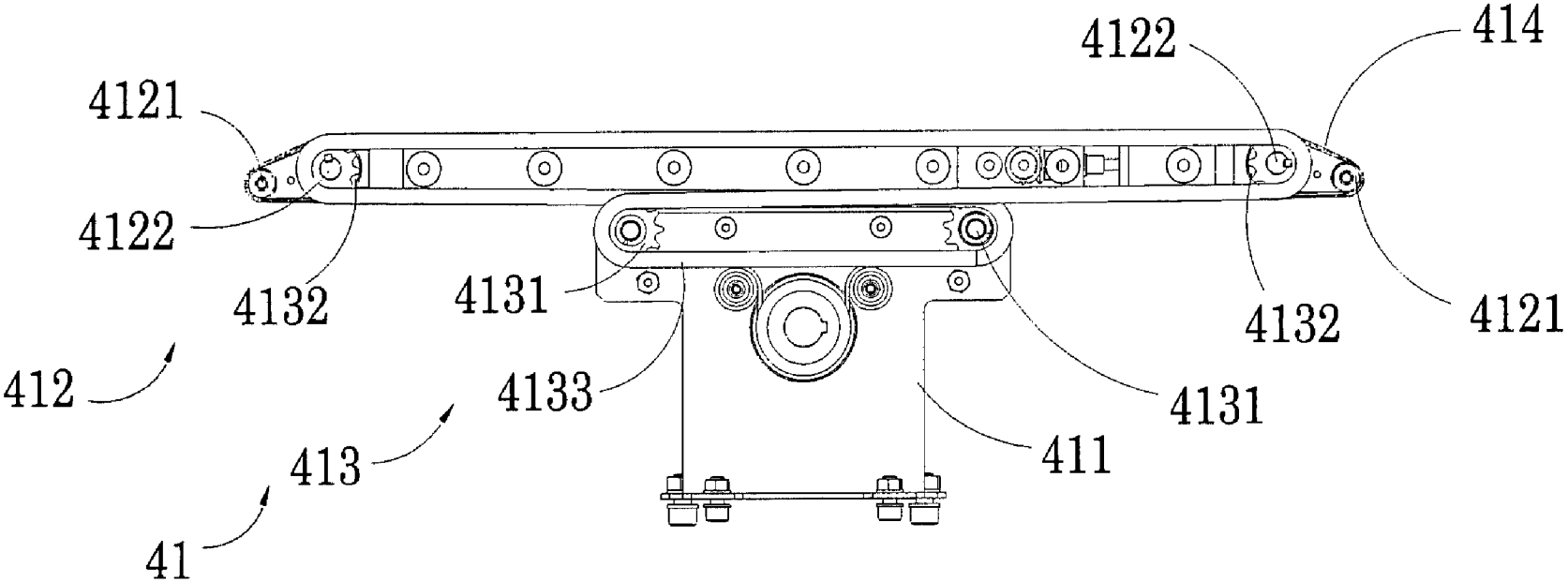
FIG. 5 is a side view of the platform driving device of the automatic patient transfer system according to the above preferred embodiment of the present invention.

As shown in FIGS. 4 to 6, the platform gear unit 413 comprises two spaced apart motor gears 4131 coupling with the platform driving motor 411, two shaft gears 4132 coupling with the shaft units 412 respectively and an endless transmission belt 4133 coupling the motor gears 4131 with the shaft gears 4132 in such a manner that when the platform driving motor 411 operates to drive the motor gears 4131 to rotate, the shaft gears 4132 are correspondingly driven to rotate through the transmission belt 4133 to drive the shaft units 412 to rotate so as to drive the conveyer platform 30 to sidewardly slide on the supporting bed 22.

Accordingly, the two shaft gears 4132 are coupled with the two inner shafts 4122 of the shaft units 412 respectively such that when the platform driving motor 411 operates, the two outer shafts 4121 are driven to rotate to provide the linear rotating movement to drive the conveyer platform 30 to slide sidewardly.

As shown in FIGS. 5 and 6, the transmission belt 4133, having a "8" shape, has a lower loop engaging with the motor gears 4131 and an upper loop engaging with the shaft gears 4132 to transmit a rotating power of the platform driving motor 411 to the shaft units 412. It is worth to mention that the "8" shaped transmission belt 4133 can provide a smooth and silent movement to transmit the rotating power of the platform driving motor 411 to the shaft units 412.

According to the preferred embodiment, the bed driving device 42 comprises a bed driving motor 421 mounted at the transport cart 10 underneath the supporting frame 20 to electrically connect with the control panel 43 and a bed gear unit 422 coupling the bed driving motor 421 with the supporting bed 22 to drive the supporting bed 22 to sidewardly slide on the transporting cart 10.

The bed driving motor 421 is another electric motor electrically connecting to the control panel 43 to drive the supporting bed 22 to sidewardly slide via the bed gear unit 422. However, the bed driving motor 421 can be integrated with the platform driving motor 411 to form a single motor unit to operate both the supporting bed 22 and the conveyer platform 30. It is worth to mention that when the supporting bed 22 sidewardly slides on the transporting cart 10, the platform gear unit 413 of the platform driving device 41 is slid with respect to the supporting bed 22 such that after the supporting bed 22 is slid at a desired position, the conveyer platform 30 is operated to slide sidewardly on the supporting bed 22.

In order to guide the sliding movement of the supporting bed 22, each of the transverse arms 21 has a sliding slot 211 slidably engaging with a corresponding edge of the supporting bed 22 to guide the supporting bed 22 to slide sidewardly, as shown in FIG. 2.

Alternatively, the electric motor of the platform driving motor 411 is operatively coupling with the shaft units 412 via a gear unit, wherein the power output of the platform driving motor 411 generates a rotating output power to drive the shaft units through the gear unit such that the transmission belt 4133 can be omitted by simply substituting the gear unit to drive the shaft units 412 to rotate.

Figure 12:
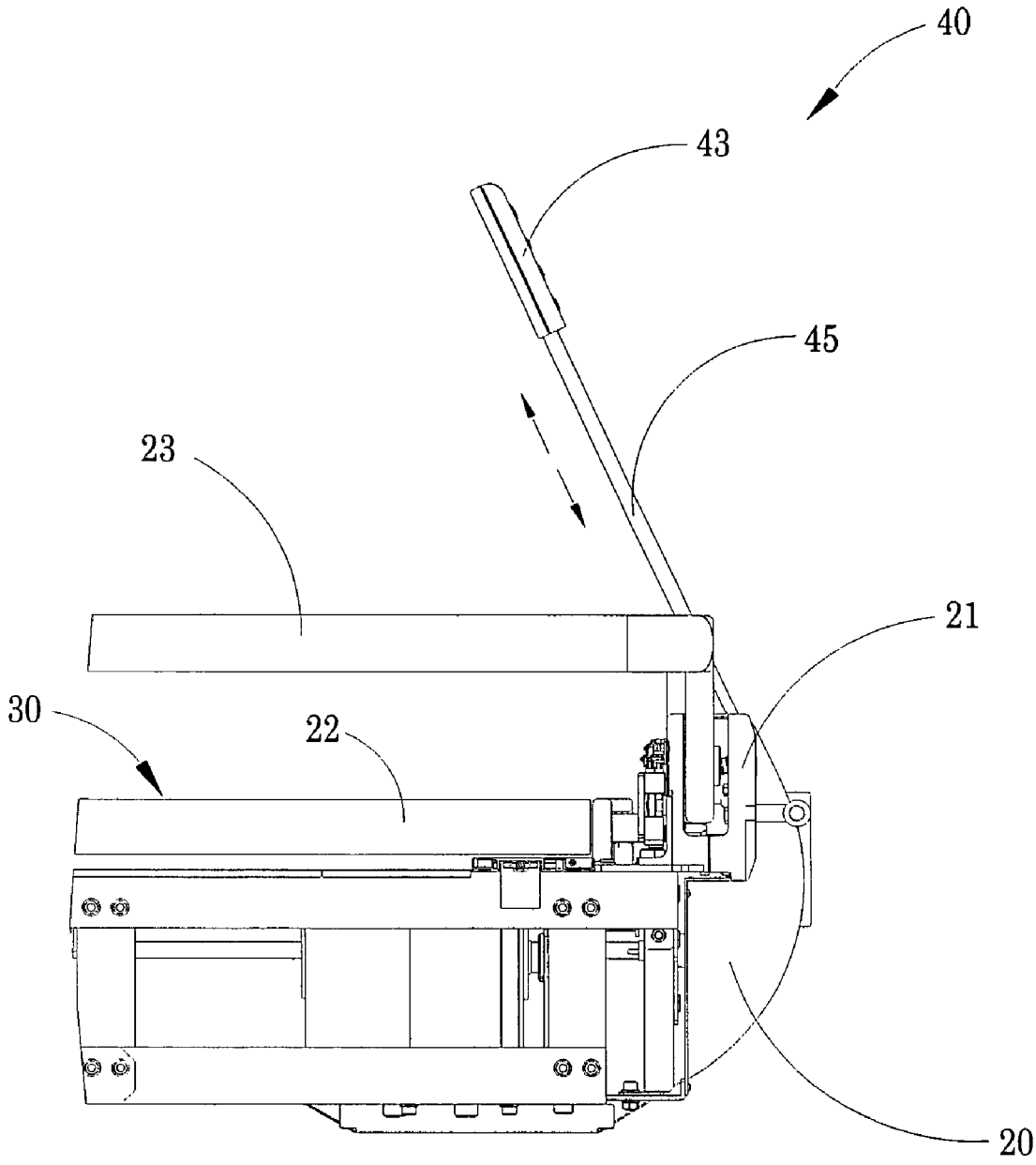
FIG. 12 is a side view of a retractable arm of the platform tension adjuster of the automatic patient transfer system according to the above preferred embodiment of the present invention, illustrating the control panel being pulled out via the retractable arm.
Figure 13:
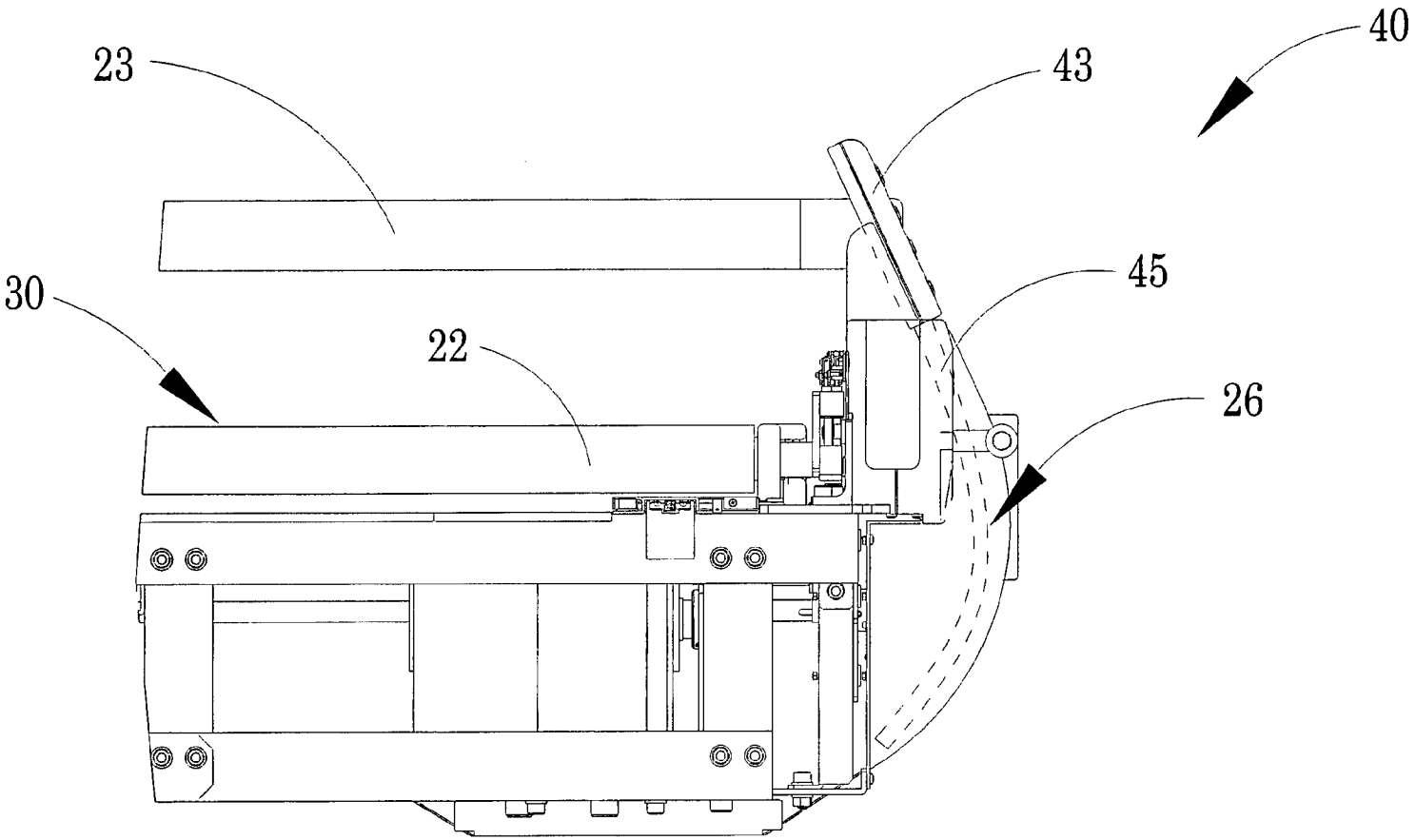
FIG. 13 is a side view of a retractable arm of the platform tension adjuster of the automatic patient transfer system according to the above preferred embodiment of the present invention, illustrating the control panel being received in a receiving cavity.

As shown in FIGS. 12 and 13, the power control mechanism 40 further comprises a retractable arm 45 retractably extended from the supporting frame 20 to the control panel 43 such that the control panel 43 is adapted to be selectively pulled out from the supporting frame 20 with a predetermined length of the retractable arm 45 to control the conveyer platform 30 and the supporting bed 22. Accordingly, the supporting frame 20 further has a receiving cavity 26 to receive the control panel 43 as shown in FIG. 13. In other words, the retractable arm 45 is retractably extended from the receiving cavity 26 to the control panel 43.

Figure 10:
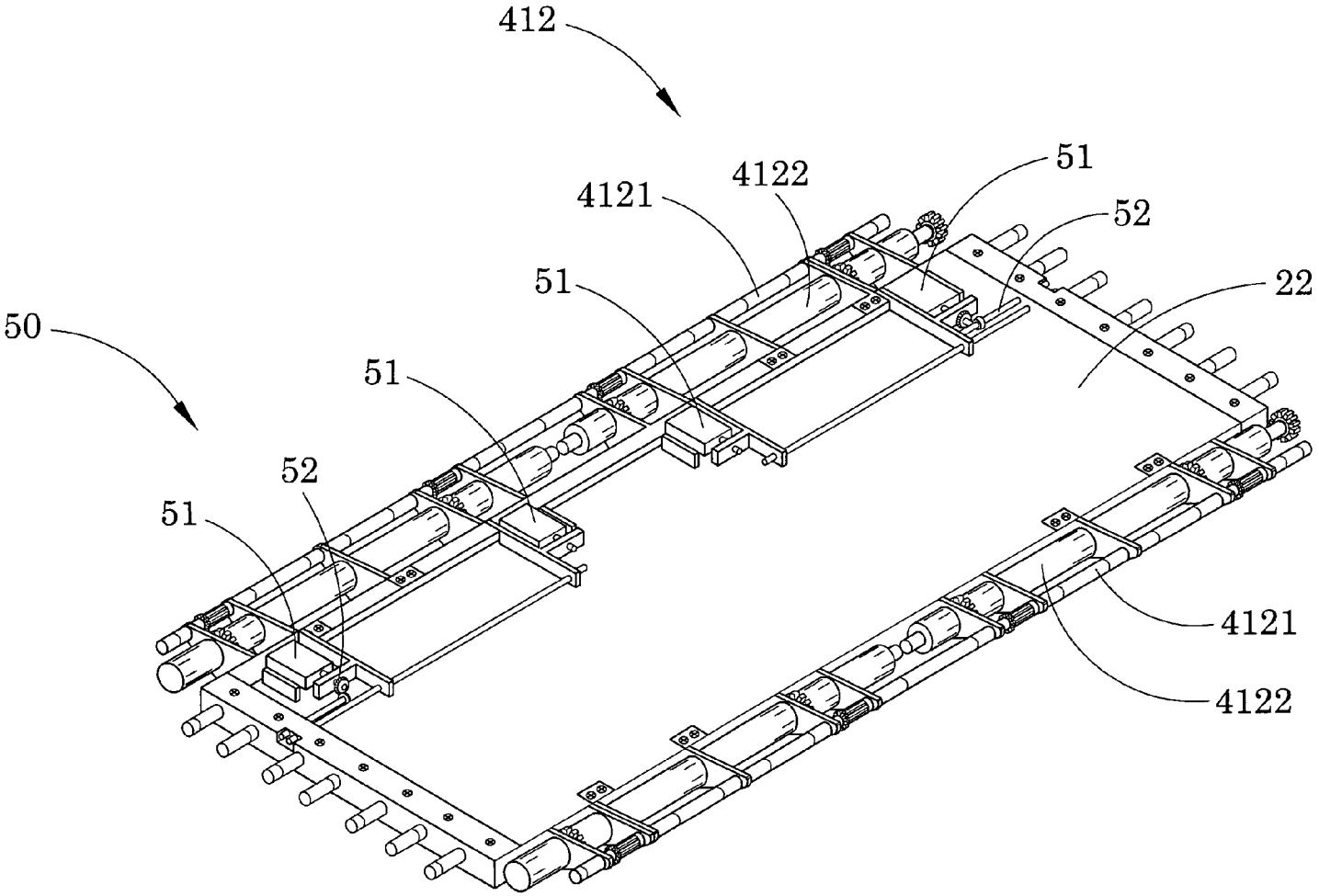
FIG. 10 is a perspective view of a platform tension adjuster of the automatic patient transfer system according to the above preferred embodiment of the present invention.
Figure 11:
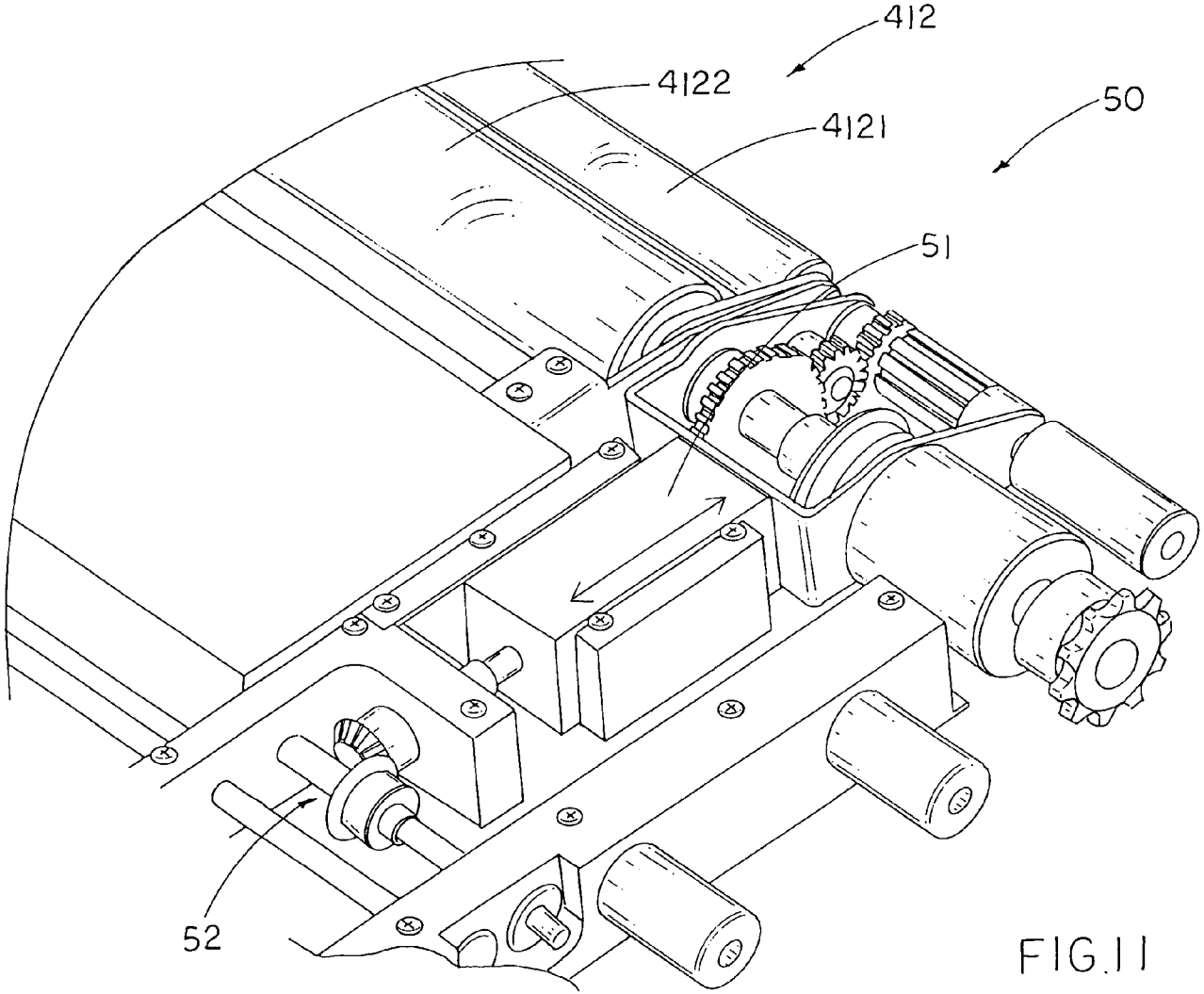
FIG. 11 is a partially perspective view of the platform tension adjuster of the automatic patient transfer system according to the above preferred embodiment of the present invention, illustrating the sliding pushers moving towards the shaft unit.

As shown in FIGS. 10 and 11, the automatic patient transfer system further comprises a platform tension adjuster 50 for selectively adjusting the tension of the conveyer platform 30, wherein the platform tension adjuster 50 comprises at least two sliding pushers 51 slidably mounted on the supporting bed 22 within the loop of the conveyer platform 30 and a tension controller 52 mounted at the supporting frame 20 to adjustably move the sliding pushers 51 towards one of the shaft units 412 so as to adjustably control the tension of the conveyer platform 30. In other words, when the sliding pushers 51 slide towards the shaft unit 412 via the tension controller 52, the tension of the conveyer platform 30 is substantially increased. Likewise, the tension of the conveyer platform 30 is reduced when the sliding pushers 51 slide away the shaft unit 412.

Figure 14:
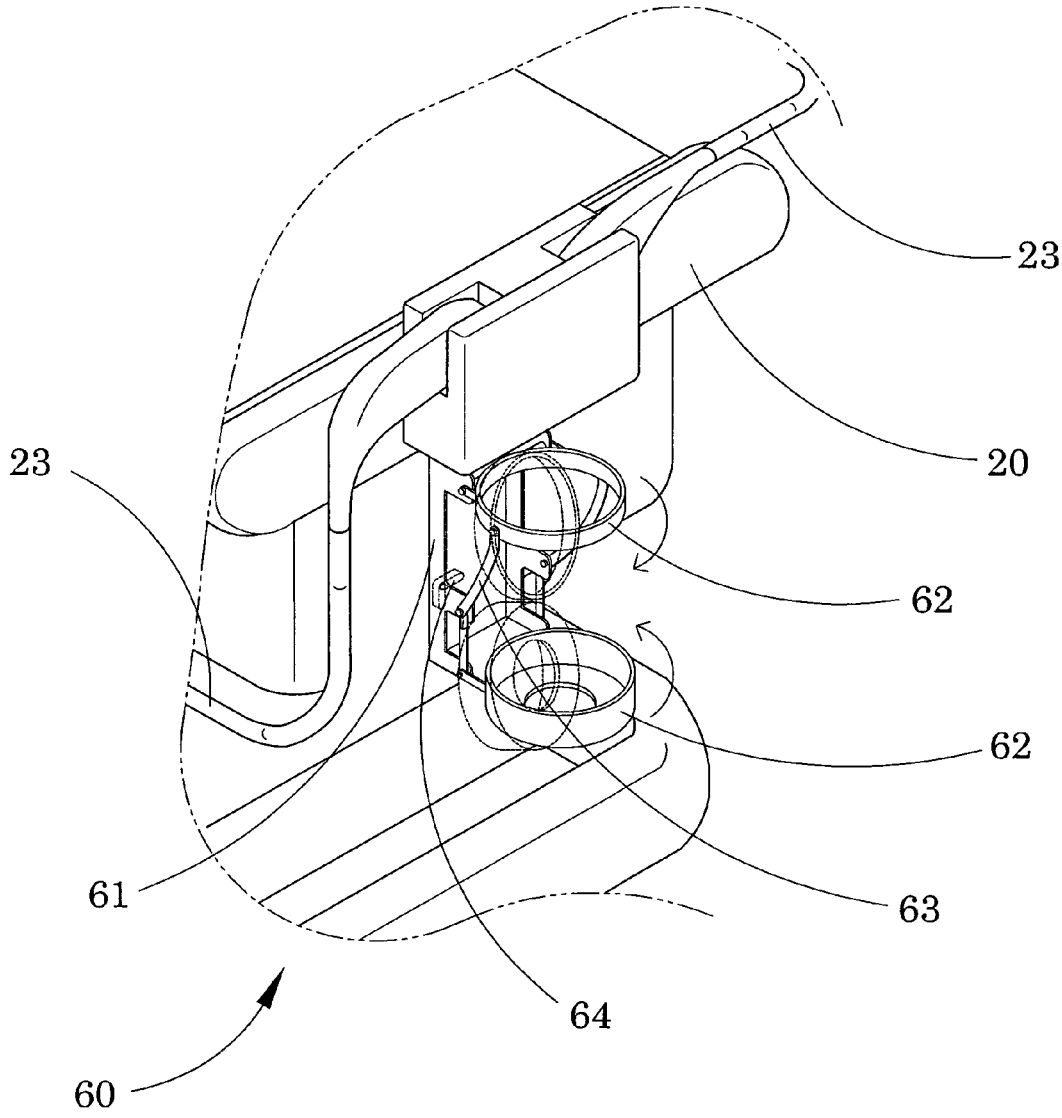
FIG. 14 is a perspective view of a bottle holder of the automatic patient transfer system according to the above preferred embodiment of the present invention.

As shown in FIG. 14, the automatic patient transfer system further comprises a foldable bottle holder 60 coupling with supporting frame 20 for holding a bottle oxygen, wherein the foldable bottle holder 60 comprises a base panel 61 detachably attaching to the supporting frame 20, two spaced apart holding rings 62 pivotally mounting to upper and lower portions of the base panel 61 respectively, and a folding arm 63 pivotally coupling the two holding rings 62 with the base panel 61 to retain the holding rings 62 at a position that the holding rings 62 are pivotally folded to coaxially align with each other for holding the bottle oxygen therebetween and that the holding rings 62 are pivotally folded to rest on the base panel 61 so as to fold up the holding rings 62. The foldable bottle holder 60 further comprises a ring locker 64 provided on the base panel 61 to operatively engage with the folding arm 63 so as to releasably lock up the holding rings 62 in position when the bottle oxygen is retained by the holding rings 62. Preferably, the foldable bottle holder 60 is mounted at one side of the supporting frame 20 while the control panel 43 is mounted at another side of the supporting frame 20.

In order to load the patient on the bed to the automatic patient transfer system, the medical attendant is able to move the transporting cart 10 at either side of the bed. Then, the medical attendant lifts up the supporting frame 20 via the hydraulic device 44 by controlling the control panel 43 until the supporting bed 22 is positioned slightly above the bed. The supporting bed 22 is operatively controlled by the control panel 43 to sidewardly slide towards the bed while the patient is slightly lifted up at one side to allow the supporting bed 22 slides underneath the patient. The medical attendant is able to operate the control panel 43 to rotatably side the conveyer platform 30 to load the patient thereon. Lastly, the supporting bed 22 is slid back on the transporting cart 10 to transport the patient.

The unloading operation of the automatic patient transfer system is easy that the medical attendant is able to move the transporting cart 10 at either side of the bed, to lift up the supporting bed 22 at a position slightly above the bed, to sidewardly slide the supporting bed 22 towards the bed, and to rotatably slide the conveyer platform 30 to unload the patient from the conveyer platform 30 to the bed.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An automatic patient transfer system for loading, unloading, and transporting a patient, comprising:

a transporting cart which comprises a base stand and a plurality of wheels rotatably mounted underneath said base stand;

a supporting frame mounted on said transporting cart in vertically movable manner to adjust a height of said supporting frame, wherein said supporting frame comprises two spaced apart transverse arms and a supporting bed, having a two-side-accessing ability, slidably mounted between said two transverse arms in a horizontal movable manner, such that said supporting bed is selectively and sidewardly slid with respect to said transporting cart to allow said supporting bed selectively sliding at two opposing sideward directions; and an endless conveyer platform slidably mounted at said supporting bed in loop manner, wherein said conveyer platform is adapted for supporting said patient thereon to selectively load and unload the patient on said supporting bed when said conveyer platform is endlessly rotated at clockwise and counter-clockwise directions, wherein said supporting frame further comprises two side guiders longitudinally extended along two sides of said supporting bed respectively, wherein each of said side guiders has two ends pivotally coupling with said transverse arms respectively to pivotally fold at a upper guiding position that said side guider is upwardly folded above said supporting bed to block said supporting bed sliding sidewardly and at a lower accessible position that said side guider is downwardly folded below said supporting bed to allow said supporting bed to slide sidewardly.

2. The automatic patient transfer system, as recited in claim 1, wherein said supporting frame further comprises two guider lockers mounted at one of said transverse arms to selectively lock up said side guiders at said guiding position.

3. An automatic patient transfer system for loading, unloading, and transporting a patient, comprising:

a transporting cart which comprises a base stand and a plurality of wheels rotatably mounted underneath said base stand;

a supporting frame mounted on said transporting cart in vertically movable manner to adjust a height of said supporting frame, wherein said supporting frame comprises two spaced apart transverse arms and a supporting bed, having a two-side-accessing ability, slidably mounted between said two transverse arms in a horizontal movable manner, such that said supporting bed is selectively and sidewardly slid with respect to said transporting cart to allow said supporting bed selectively sliding at two opposing sideward directions;

an endless conveyer platform slidably mounted at said supporting bed in loon manner, wherein said conveyer platform is adapted for supporting said patient thereon to selectively load and unload the patient on said supporting bed when said conveyer platform is endlessly rotated at clockwise and counter-clockwise directions; and a power control mechanism to automatically control said supporting bed and said conveyer platform, wherein said power control mechanism comprises a platform driving device operatively driving said conveyer platform to sidewardly slide on said supporting bed, a bed driving device operatively driving said supporting bed to sidewardly slide on said transporting cart, and a control panel electrically connecting with said platform driving device and said bed driving device to selectively operate said conveyer platform and said supporting bed, wherein said platform driving device comprises a platform driving motor mounted at said transport cart underneath said supporting frame to electrically connect with said control panel, two shaft units longitudinally and rotatably extended along two sides of said supporting bed to abut against an inner surface of said conveyer platform, and a platform gear unit coupling said platform driving motor with said shaft units in such a manner that when said platform driving motor operates, said shaft units are driven to rotate through said platform gear unit so as to provides a linear rotating movement at each of said shaft units to drive said conveyer platform to slidably rotate on said supporting bed, wherein said platform gear unit comprises two spaced apart motor gears coupling with said platform driving motor. two shaft gears coupling with said shaft units respectively and an endless transmission belt coupling said motor gears with said shaft gears in such a manner that when said platform driving motor operates to drive said motor gears to rotate, said shaft gears are correspondingly driven to rotate through said transmission belt to drive said shaft units to rotate so as to drive said conveyer platform to sidewardly slide on said supporting bed, wherein said platform driving device further comprises an endless synchronizing belt engaging with two shaft units to synchronize said two shaft units while being rotated, wherein said supporting frame further comprises two side guiders longitudinally extended along two sides of said supporting bed respectively, wherein each of said side guiders has two ends pivotally coupling with said transverse arms respectively to pivotally fold at a upper guiding position that said side guider is upwardly folded above said supporting bed to block said supporting bed sliding sidewardly and at a lower accessible position that said side guider is downwardly folded below said supporting bed to allow said supporting bed to slide sidewardly.

4. The automatic patient transfer system, as recited in claim 3, wherein said supporting frame further comprises two guider lockers mounted at one of said transverse arms to selectively lock up said side guiders at said guiding position.

5. An automatic patient transfer system for loading, unloading, and transporting a patient, comprising:

a transporting cart which comprises a base stand and a plurality of wheels rotatably mounted underneath said base stand;

a supporting frame mounted on said transporting cart in vertically movable manner to adjust a height of said supporting frame, wherein said supporting frame comprises two spaced apart transverse arms and a supporting bed, having a two-side-accessing ability, slidably mounted between said two transverse arms in a horizontal movable manner, such that said supporting bed is selectively and sidewardly slid with respect to said transporting cart to allow said supporting bed selectively sliding at two opposing sideward directions;

an endless conveyer platform slidably mounted at said supporting bed in loop manner, wherein said conveyer platform is adapted for supporting said patient thereon to selectively load and unload the patient on said supporting bed when said conveyer platform is endlessly rotated at clockwise and counter-clockwise directions; and a power control mechanism to automatically control said supporting bed and said conveyer platform, wherein said cower control mechanism comprises a platform driving device operatively driving said conveyer platform to sidewardly slide on said supporting bed, a bed driving device operatively driving said supporting bed to sidewardly slide on said transporting cart, and a control panel electrically connecting with said platform driving device and said bed driving device to selectively operate said conveyer platform and said supporting bed, wherein said platform driving device comprises a platform driving motor mounted at said transport cart underneath said supporting frame to electrically connect with said control panel, two shaft units longitudinally and rotatably extended along two sides of said supporting bed to abut against an inner surface of said conveyer platform, and a platform gear unit coupling said platform driving motor with said shaft units in such a manner that when said platform driving motor operates, said shaft units are driven to rotate through said platform gear unit so as to provides a linear rotating movement at each of said shaft units to drive said conveyer platform to slidably rotate on said supporting bed, wherein said platform gear unit comprises two spaced apart motor gears coupling with said platform driving motor, two shaft gears coupling with said shaft units respectively and an endless transmission belt coupling said motor gears with said shaft gears in such a manner that when said platform driving motor operates to drive said motor gears to rotate, said shaft gears are correspondingly driven to rotate through said transmission belt to drive said shaft units to rotate so as to drive said conveyer platform to sidewardly slide on said supporting bed, wherein said platform driving device further comprises an endless synchronizing belt engaging with two shaft units to synchronize said two shaft units while being rotated, wherein said bed driving device comprises a bed driving motor mounted at said transport cart underneath said supporting frame to electrically connect with said control panel and a bed gear unit coupling said bed driving motor with said supporting bed to drive said supporting bed to sidewardly slide on said transporting cart, wherein each of said transverse arms has a sliding slot slidably engaging with a corresponding edge of said supporting bed to guide said supporting bed to slide sidewardly, wherein said supporting frame further comprises two side guiders longitudinally extended along two sides of said supporting bed respectively, wherein each of said side guiders has two ends pivotally coupling with said transverse arms respectively to pivotally fold at a upper guiding position that said side guider is upwardly folded above said supporting bed to block said supporting bed sliding sidewardly and at a lower accessible position that said side guider is downwardly folded below said supporting bed to allow said supporting bed to slide sidewardly.

6. The automatic patient transfer system, as recited in claim 5, wherein said supporting frame further comprises two guider lockers mounted at one of said transverse arms to selectively lock up said side guiders at said guiding position.

7. An automatic patient transfer system for loading, unloading, and transporting a patient, comprising:

a transporting cart which comprises a base stand and a plurality of wheels rotatably mounted underneath said base stand;

a supporting frame mounted on said transporting cart in vertically movable manner to adjust a height of said supporting frame, wherein said supporting frame comprises two spaced apart transverse arms and a supporting bed, having a two-side-accessing ability, slidably mounted between said two transverse arms in a horizontal movable manner, such that said supporting bed is selectively and sidewardly slid with respect to said transporting cart to allow said supporting bed selectively sliding at two opposing sideward directions;

an endless conveyer platform slidably mounted at said supporting bed in loop manner, wherein said conveyer platform is adapted for supporting said patient thereon to selectively load and unload the patient on said supporting bed when said conveyer platform is endlessly rotated at clockwise and counter-clockwise directions; and a power control mechanism to automatically control said supporting bed and said conveyer platform, wherein said power control mechanism comprises a platform driving device operatively driving said conveyer platform to sidewardly slide on said supporting bed, a bed driving device operatively driving said supporting bed to sidewardly slide on said transporting cart, and a control panel electrically connecting with said platform driving device and said bed driving device to selectively operate said conveyer platform and said supporting bed, wherein said platform driving device comprises a platform driving motor mounted at said transport cart underneath said supporting frame to electrically connect with said control panel, two shaft units longitudinally and rotatably extended along two sides of said supporting bed to abut against an inner surface of said conveyer platform, and a platform gear unit coupling said platform driving motor with said shaft units in such a manner that when said platform driving motor operates, said shaft units are driven to rotate through said platform gear unit so as to provides a linear rotating movement at each of said shaft units to drive said conveyer platform to slidably rotate on said supporting bed, wherein said platform gear unit comprises two spaced apart motor gears coupling with said platform driving motor, two shaft gears coupling with said shaft units respectively and an endless transmission belt coupling said motor gears with said shaft gears in such a manner that when said platform driving motor operates to drive said motor gears to rotate, said shaft gears are correspondingly driven to rotate through said transmission belt to drive said shaft units to rotate so as to drive said conveyer platform to sidewardly slide on said supporting bed, wherein said platform driving device further comprises an endless synchronizing belt engaging with two shaft units to synchronize said two shaft units while being rotated, wherein said bed driving device comprises a bed driving motor mounted at said transport cart underneath said supporting frame to electrically connect with said control panel and a bed gear unit coupling said bed driving motor with said supporting bed to drive said supporting bed to sidewardly slide on said transporting cart, wherein each of said transverse arms has a sliding slot slidably engaging with a corresponding edge of said supporting bed to guide said supporting bed to slide sidewardly, wherein said power control mechanism further comprises a hydraulic device mounted in said base stand to electrically connect with said control panel to selectively lift up and drop down said supporting frame by means of hydraulic force, wherein said power control mechanism further comprises a retractable arm retractably extended from said supporting frame to said control panel such that said control panel is adapted to be selectively pulled out from said supporting frame with a predetermined length of said retractable arm to control said conveyer platform and said supporting bed, wherein said supporting frame further comprises two side guiders longitudinally extended along two sides of said supporting bed respectively, wherein each of said side guiders has two ends pivotally coupling with said transverse arms respectively to pivotally fold at a upper guiding position that said side guider is upwardly folded above said supporting bed to block said supporting bed sliding sidewardly and at a lower accessible position that said side guider is downwardly folded below said supporting bed to allow said supporting bed to slide sidewardly.

8. The automatic patient transfer system, as recited in claim 7, wherein said supporting frame further comprises two guider lockers mounted at one of said transverse arms to selectively lock up said side guiders at said guiding position.

9. The automatic patient transfer system, as recited in claim 8, further comprising a platform tension adjuster for selectively adjusting a tension of said conveyer platform, wherein said platform tension adjuster comprises two sliding pushers slidably mounted on said supporting bed within said loop of said conveyer platform and a tension controller mounted at said supporting frame to adjustably move said sliding pushers towards one of said shaft units so as to adjustably control said tension of said conveyer platform.

* * * * *